United States Patent [19]

Weiler

[11] 4,231,703

[45] Nov. 4, 1980

[54] VARIABLE GUIDE VANE ARRANGEMENT AND CONFIGURATION FOR COMPRESSOR OF GAS TURBINE DEVICES

[75] Inventor: Wolfgang Weiler, Dachau, Fed. Rep. of Germany

[73] Assignee: Motoren- und Turbinen-Union Muenchen GmbH, Munich, Fed. Rep. of Germany

[21] Appl. No.: 65,099

[22] Filed: Aug. 9, 1979

[30] Foreign Application Priority Data

Aug. 11, 1978 [DE] Fed. Rep. of Germany ..... 2835349

[51] Int. Cl.[3] ..... F01B 25/02

[52] U.S. Cl. ..... 415/159; 415/147; 415/160

[58] Field of Search ..... 415/159, 160, 161, 162, 415/151, 147, 191, 216

[56] References Cited

U.S. PATENT DOCUMENTS

| | | | |
|---|---|---|---|
| 2,950,084 | 8/1960 | Perry | 415/160 |
| 3,284,048 | 11/1966 | Tumavicus | 415/160 |
| 3,303,992 | 2/1967 | Johnson | 415/160 X |
| 3,367,628 | 2/1968 | Fitton | 415/160 X |
| 3,542,484 | 11/1970 | Mason | 415/160 |
| 3,674,377 | 7/1972 | Trappmann | 415/160 X |
| 3,685,921 | 8/1972 | DeKeyser | 415/159 |

FOREIGN PATENT DOCUMENTS

| | | | |
|---|---|---|---|
| 954637 | 12/1956 | Fed. Rep. of Germany | 415/160 |
| 1136350 | 9/1962 | Fed. Rep. of Germany | 415/160 |
| 2203643 | 8/1973 | Fed. Rep. of Germany | 415/160 |
| 2740192 | 8/1979 | Fed. Rep. of Germany | 415/159 |
| 1021872 | 12/1952 | France | 415/160 |

*Primary Examiner*—Stanley N. Gilreath

*Attorney, Agent, or Firm*—Schwartz, Jeffery, Schwaab, Mack, Blumenthal & Koch

[57] ABSTRACT

Disclosed is a variable guide vane arrangement for use in a high-load compressor having at least one axial-flow stage in turbomachines including gas turbine engines, comprising a plurality of guide vanes positioned radially adjacent one another about a circumference in the axial flow stage of the compressor, each vane having a low-pressure and a high-pressure side during operation; a plurality of generally disk shaped turntable members, each of the vanes being secured at its outer end to one of the turntable members and each of the turntable members being rotatably mounted about the circumference, the diameter of each of the turntable members being greater than the spacing between adjacent guide vanes; and each of the turntable members being generally round and having a cut-out portion on the side adjacent to the low-pressure side of the guide vane secured thereto. The cut-out portion is formed by first, second and third arcs which merge together to form an edge surface adapted to closely abut the arcuate circumference of the next adjacent turntable member at all rotational settings of the guide vanes. The surface of each of the turntable members opposite to the side to which said guide vane is secured comprises a cone-shape having an apex angle equal to approximately 180°-360°/Z, wherein Z is the number of the guide vanes positioned about the circumference.

9 Claims, 3 Drawing Figures

VARIABLE GUIDE VANE ARRANGEMENT AND CONFIGURATION FOR COMPRESSOR OF GAS TURBINE DEVICES

BACKGROUND OF THE INVENTION

The present invention relates to a variable guide vane arrangement and configuration for high-load compressors, especially for use in gas turbine engines, wherein the guide vanes of at least one axial-flow stage are pivotally supported in the compressor outer casing by means of pivot pins and wherein the respective airfoil of the guide vane rests at least partially on a vane turntable connected to the pivot pin.

Variable guide vanes in variable-geometry compressors are normally designed such that, on the casing side, the airfoil rests fully or partially on a turntable which terminates at the pivot pin. While the pivot pin serves to adjust the longitudinal and circumferential position of the vane relative to the casing, the turntable maintains the position of the vane radially and primarily serves to eliminate or reduce the clearances between the vane and the casing. The diameter of the turntable varies with the number of guide vanes in the cascade and is normally selected such that the land remaining between adjacent holes or recesses for the turntables in the casing remains sufficiently thick and cannot be pushed into the adjacent hole during machining.

As is known, the number of vanes in a cascade depends largely upon the aerodynamic load. As the cascade load increases, the cascade pitch grows closer. For the reasons cited above, this will accordingly reduce the feasible diameter of the turntable. As a result, again, the length of the gap on the casing side increases (and the flow losses rise), and simultaneously the base on which the airfoil rests is reduced. The latter effect has a tremendous influence on vibrations and, therefore, the operational reliability of the components involved.

SUMMARY OF THE INVENTION

It is therefore an object of the present invention to provide an improved variable guide vane arrangement for use in a high-load compressor which obviates all of the above-mentioned disadvantages.

Another object of the invention resides in providing a variable guide vane arrangement for use in compressors having a very close vane pitch.

A further object of the invention is to provide a variable guide vane arrangement providing maximum turntable diameter and, hence, low vibration characteristics.

It is also an object of the invention to provide a variable guide vane arrangement which produces minimum aerodynamic losses.

Still another object of the invention resides in providing an improved compressor and an improved turbomachine embodying same.

In accomplishing these objects, there has been provided in accordance with the present invention a variable guide vane arrangement for use in a high-load compressor having at least one axial-flow stage in turbomachines, including gas turbine engines, comprising a plurality of guide vanes positioned radially adjacent one another about a circumference in the axial flow stage of the compressor, each vane having a low-pressure and a high-pressure side during operation; a plurality of generally disk shaped turntable members, each of the vanes being secured at its outer end to one of these turntable members and each of the turntable members being rotatably mounted about the circumference, with the diameter of each of the turntable members being greater than the spacing between adjacent guide vanes. Each of the turntable members is generally round and have a cut-out portion on the side adjacent to the low-pressure side of the guide vane secured thereto. The cut-out portion is formed by first, second and third arcs which merge together to form an edge surface adapted to closely abut the arcuate circumference of the next adjacent turntable member at all rotational settings of the guide vanes. The first and third arcs curve toward the low-pressure side of the vane and the second arc is positioned between the first and third arcs and is curved away from the low-pressure side.

According to another aspect of the present invention, the surface of each of the turntable members opposite to the side to which the guide vane is secured comprises a cone shape having an apex angle equal to approximately 180°-360°/Z, wherein Z is the number of said guide vanes positioned about the circumference.

In accordance with still another aspect of the invention, there has been provided a turbomachine comprising a compressor having at least one axial-flow stage and a variable guide vane arrangement positioned in said axial-flow stage, wherein said variable guide vane arrangement comprises the improved design described above.

Other objects, features and advantages of the invention will become apparent from the detailed description of preferred embodiments which follows, when considered in light of the attached figures of drawing.

DETAILED DESCRIPTION OF PREFERRED EMBODIMENTS

In a broad aspect the present invention provides a variable guide vane cascade of relatively close vane pitch and relatively large turntable diameters, which, while giving high operational reliability, is characterized by very modest aerodynamic losses in the turntable area over the entire vane actuating range.

The geometry provided in accordance with the present invention ensures that the sum of the areas formed by the wedges or gussets resulting from the cooperation of two adjacent variable guide vanes with the compressor casing, such wedges or gussets constituting potential points of disturbance in the flow duct, are minimized and also that, in any position of the cascade, the gap interconnecting the two wedges or gussets will remain constant.

Inasmuch as the relative airfoil-to-turntable arrangement can be freely selected within liberal limits, the design thereof can be used to benefit the properties of the cascade with a view to both mechanical vibrations and aerodynamics. In particular, it will be possible, depending on the position of the wedges or gussets relative to the airfoil, to use secondary air flow arrangements to affect the boundary layer for improved efficiency and performance of the compressor.

Conical configuration of the end of the turntable adjacent the pin providing a common generating line for two adjacent recesses in the casing benefits the sealing effort required in this area.

Figure 1:
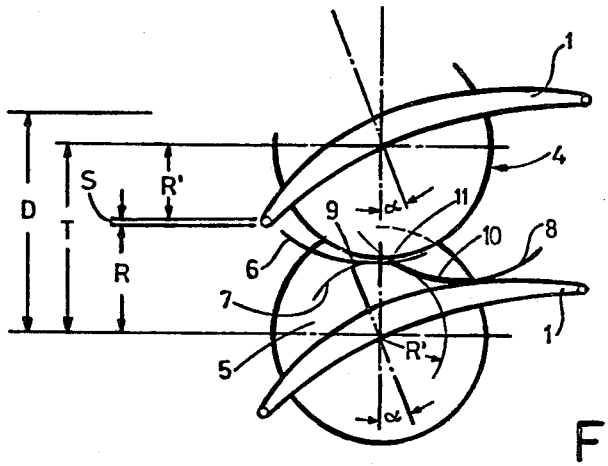
FIG. 1 is a schematic view illustrating the arrangement and configuration of a guide vane cascade in full-load position.
Figure 3:
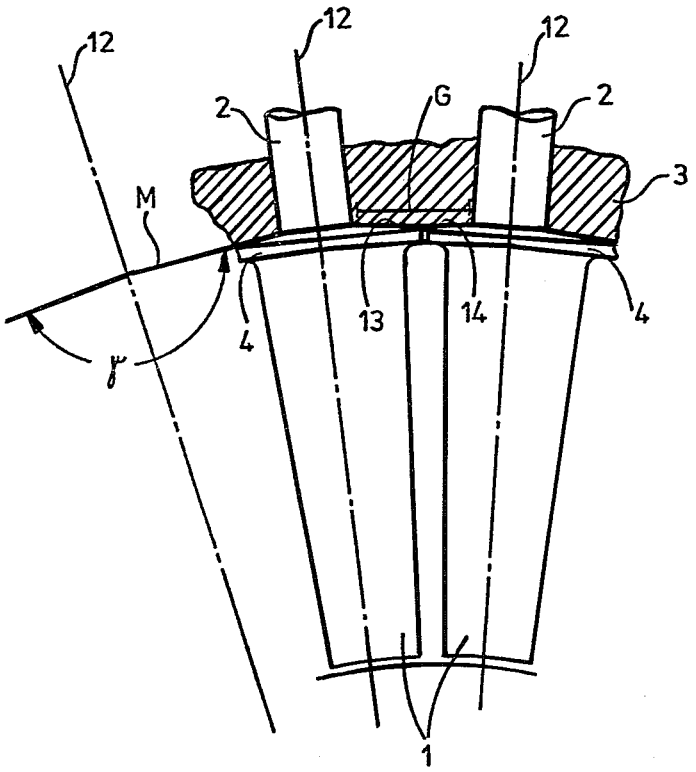
FIG. 3 is an isolated front view of the pair of vanes in relative arrangement with a compressor outer casing section (with parts broken away for clarity of presentation) and an inner wall section of the compressor flow duct.

Referring to the drawings, FIGS. 1 and 3 illustrate two adjacent variable guide vanes 1 of a variable vane cascade of an axial-flow compressor. The guide vanes 1 are pivotally supported in the compressor casing 3 by means of pivot pins 2, where the respective airfoil rests with a relatively large portion of its chordal length on a vane turntable 4, which is connected to the respective pivot pin 2.

As will become apparent especially from FIG. 1, in the variable vane cascade of the present invention, the diameter D of each vane turntable 4 is larger than the underlying cascade pitch T, i.e., the spacing between adjacent vanes.

In what would otherwise be an overlap area of the turntables 4, each turntable exhibits at the turntable section 5, adjacent to the suction or low-pressure side of the vane, a cutback formed by three arcs 6, 7, 8 blending or merging one into the other.

The end of turntable 4 which is cut back along the three arcs 6, 7, 8 consists of two consecutive portions 9 and 10 curved toward, i.e., convex to, the suction side of the vane, the respective curvature being defined by the radius R of the turntable.

A transitional section 11, curved toward the rim of the adjacent turntable between the portions 9 and 10, is defined by a radius R', resulting from the cascade pitch T less the turntable radius R and the requisite clearance S:

$$R' = T - (R + S)$$

With reference to FIG. 3, the end of each vane turntable 4 facing the pivot pin takes the shape of a cone flaring at an angle $\gamma = 180° - 360°/Z$, where Z is the number of guide vanes in a cascade. The respective axes of rotation of the guide vanes are indicated in FIG. 3 by the numeral 12.

The previously described arrangement always provides a common generating line M for two adjacent turntable portions, as it will become apparent from the straight lines G extending in FIG. 3 parallel to the two recesses 13, 14.

Figure 2:
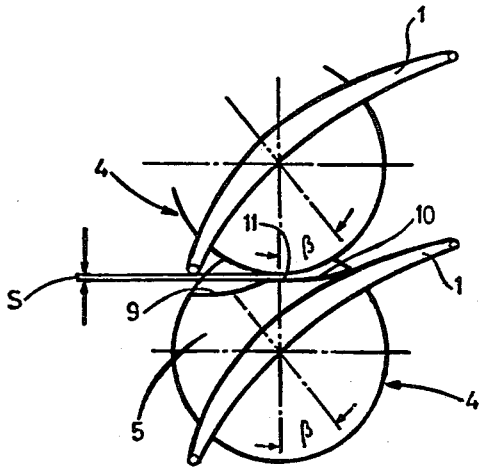
FIG. 2 is a similar view illustrating the arrangement and configuration of the pair of vanes of FIG. 1, but now in a lower, partial-load condition.

The shape of the cutback of the turntable, of the sectional end of the turntable, makes it possible despite the relatively close vane pitch T and relatively large turntable diameters D to pivot the guide vanes 1 freely into widely different, extreme positions (such as the full-load position in FIG. 1 and the lower partial-load position in FIG. 2) while minimizing and maintaining the gap S between the transitional section 11 and an adjacent curved face of a turntable 4 having a radius R, and in fact, over the entire actuating range of the vane.

The arrangement of FIG. 3 permits the gap S formed between two vane turntables to be maintained at a constant value, regardless of the vane position, which again greatly helps minimize the gap S.

The initially mentioned "wedges" or "gussets" embrace, in connection with the present invention, those sections which are formed essentially between the arched portions 9 and 10 on the turntable section 5 and an adjacent unmodified, circular face of an adjacent turntable 4.

The irregular shape of the duct wall will produce small swirls in the area of these wedges or gussets, similer to the action of turbulence generators mounted on aircraft wings. These small swirls can be used to carry certain amounts of energy to the boundary layer to prevent its premature separation from the wall.

The variable guide vane arrangement according to the present invention may be used advantageously in a gas turbine engine of the type disclosed in U.S. Pat. No. 4,147,026, the disclosure of which is hereby incorporated by reference.

What is claimed is:

1. A variable guide vane arrangement for use in a high-load compressor having at least one axial-flow stage in turbomachines including gas turbine engines, comprising:

a plurality of guide vanes positioned radially adjacent one another about a circumference in the axial flow stage of the compressor, each vane having a low-pressure and a high-pressure side during operation;

a plurality of generally disk shaped turntable members, each of said vanes being secured at its outer end to one of said turntable members and each of said turntable members being rotatably mounted about said circumference, the diameter of each of said turntable members being greater than the spacing between adjacent guide vanes; and each of said turntable members being generally round and having a cut-out portion on the side adjacent to the low-pressure side of said guide vane secured thereto, said cut-out portion being formed by first, second and third arcs which merge together to form an edge surface adapted to closely abut the arcuate circumference of the next adjacent turntable member at all rotational settings of said guide vanes.

2. A variable guide vane arrangement as defined by claim 1, wherein said first and third arcs are curved toward the low-pressure side of said vane and said second arc is positioned between said first and third arcs and is curved away from said low-pressure side.

3. A variable guide vane arrangement as defined by claim 2, wherein the radius of curvature of said first and third arcs comprises essentially the radius of the arcuate portion of said turntable members.

4. A variable guide vane arrangement as defined by claim 3, wherein the radius of curvature of said second arc comprises essentially the center-line distance between adjacent guide vanes minus said turntable member radius.

5. A variable guide vane arrangement as defined by claim 4, wherein the radius of curvature of said second arc equals the center-line distance between adjacent guide vanes minus said turntable member radius and the clearance between adjacent turntable members.

6. A variable guide vane arrangement as defined by claim 1, wherein the surface of each of said turntable members opposite to the side to which said guide vane is secured comprises a cone shape having an apex angle equal to approximately 180°-360°/Z, wherein Z is the number of said guide vanes positioned about said circumference.

7. A variable guide vane arrangement as defined by claim 6, wherein the outer casing of the compressor comprises adjacent recesses for receiving each of said turntable members and wherein the neighboring halves of each two adjacent recesses comprise surfaces opposite to the recess opening which lie on a common straight line.

8. A variable guide vane arrangement as defined by claim 1, wherein the shape of said first, second and third arcs is selected so that the clearance between said edge surface of each turntable member and said arcuate circumference of the adjacent turntable member remains constant for all rotational settings of said guide vanes.

9. A turbomachine comprising a compressor having at least one axial-flow stage and a variable guide vane arrangement positioned in said axial-flow stage, wherein said variable guide vane arrangement is as defined by claim 1.

* * * * *